United States Patent [19]

Saito et al.

[11] 4,365,729

[45] Dec. 28, 1982

[54] ATOMIZER

[75] Inventors: Tadao Saito; Takao Kishi; Yoshiyuki Kakuta, all of Tokyo, Japan

[73] Assignee: Yoshino Kogyosho Co., Ltd., Tokyo, Japan

[21] Appl. No.: 214,957

[22] Filed: Dec. 9, 1980

[30] Foreign Application Priority Data

Sep. 22, 1980 [JP] Japan ..... 55-131981

[51] Int. Cl.[3] ..... B05B 9/00

[52] U.S. Cl. ..... 222/321; 222/385; 239/333

[58] Field of Search ..... 222/321, 380, 385; 239/333

[56] References Cited

U.S. PATENT DOCUMENTS 4,017,031 4/1977 Kishi et al. ..... 239/333
4,174,790 11/1979 Nozawa et al. ..... 222/385
4,277,001 7/1981 Nozawa ..... 222/385
4,317,531 3/1982 Saito et al. ..... 222/321

*Primary Examiner*—H. Grant Skaggs
*Attorney, Agent, or Firm*—Stevens, Davis, Miller & Mosher

[57] ABSTRACT

In order to effect the opening and closing operations of a control valve leading to a nozzle, an actuating chamber is defined by a piston and a cylinder and is made to have communication with the pressurizing chamber of the pressurizing means of an atomizer. In order to regulate the movement of the piston, the actuating chamber has its lower portion formed with a stopper for preventing the substantial volume of the pressurizing chamber from being abruptly increased. The stopper has its lower portion formed with a depending cylinder for guiding the downward movement of the aforementioned piston.

5 Claims, 2 Drawing Figures

ATOMIZER

BACKGROUND OF THE INVENTION

1. Field of the Invention

The present invention relates to an atomizer for manually atomizing a liquid such as a wash or a medicine.

2. Description of the Prior Art

In one of the manual type atomizers according to the prior art, a communication hole leading to a nozzle is opened to effect the atomization in accordance with the internal pressure of a pressurizing chamber which is operative to such up and pressurize a liquid. In the construction of the atomizer of that type, an actuating chamber having communication with the pressurizing chamber is defined by the combination of a cylinder and a piston for opening and closing the communication hole so that, when the pressure in the actuating chamber is increased, the operating piston is moved down so that a valve member carried by the operating piston opens the communication passage leading to the nozzle. In the construction thus made, however, the operating piston may be considerably moved down by the pressure in the actuating chamber. In this case, the volume of the actuating chamber may be abruptly increased, inviting the substantial increase in the volume of the pressurizing chamber, because the actuating chamber and the pressurizing chamber have communication with each other. As a result, the pressure in the pressurizing chamber may be lowered to make it impossible to ensure the desired atomization.

In that case, moreover, the actuating chamber is formed in a shape to protrude above the pressurizing chamber. In order to effect the pumping action of the pressurizing chamber, therefore, an atomizing head may be depressed, while being guided only by the relative slide between the piston and the cylinder at one lower portion, thus hardly succeeding in stably and smoothly effecting the pumping action. Another drawback raised is that the liquid pressurized leaks through the sliding surfaces between the cylinder and the piston defining the actuating chamber.

SUMMARY OF THE INVENTION

It is therefore an object of the present invention to eliminate the drawbacks thus far described and to provide an atomizer of the type, in which the depression of a valve member for opening a communication hole leading to a nozzle is so regulated as to prevent the substantial volume of a pressurizing chamber from being abruptly increased, thereby to make it possible to effect the excellent atomization.

Another object of the present invention is to provide an atomizer of the type, in which a depending cylinder for establishing vertical communication between an operating cylinder and a cylinder forming a pressurizing chamber is separately provided and has its lower portion sliding in the cylinder forming the pressurizing chamber so that the pumping action may be effected smoothly and stably and so that the liquid having leaked from the operating chamber, if any, may be guided through said depending cylinder into atomizing means.

DESCRIPTION OF THE PREFERRED EMBODIMENT

Figure 1:
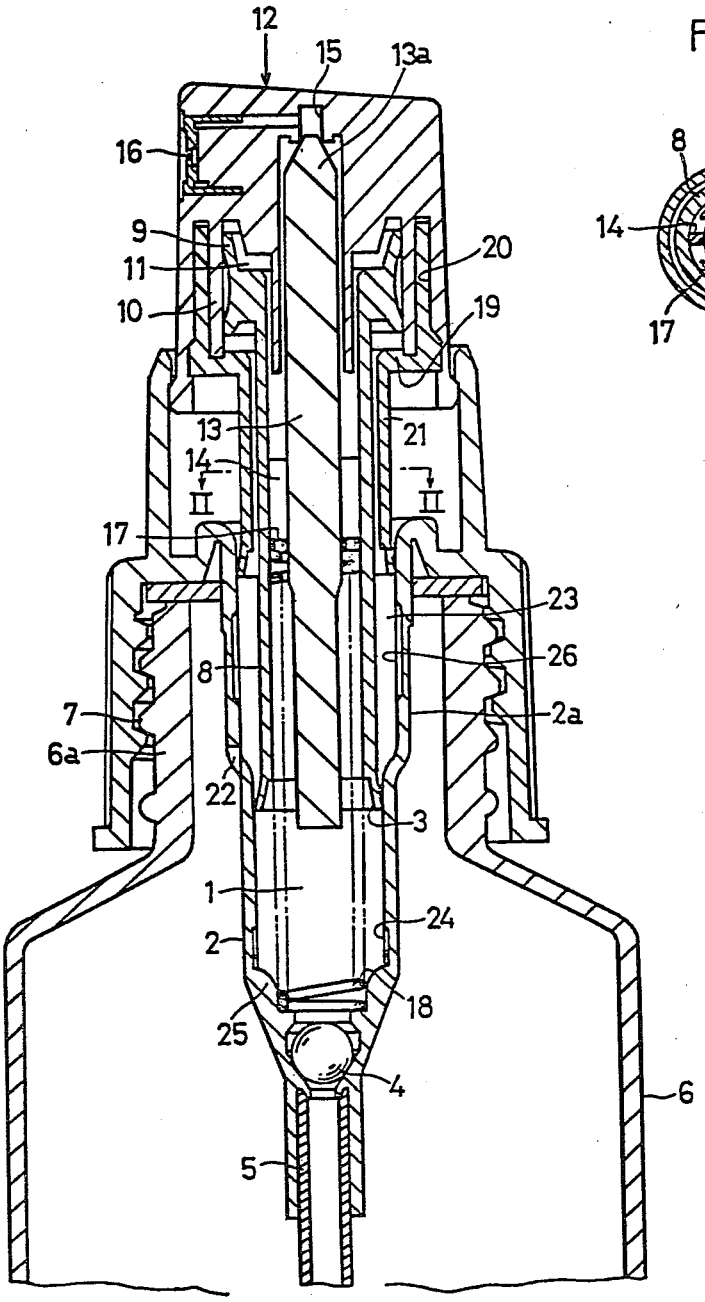
FIG. 1 is a sectional side elevation showing an atomizer according to the present invention.
Figure 2:
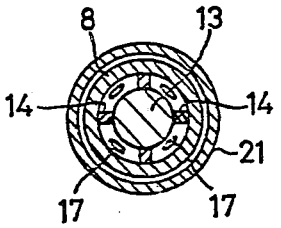
FIG. 2 is a section taken along line II—II of FIG. 1.

The atomizer according to the present invention will be described in the following with reference to the accompanying drawing. The atomizer has its pressurizing chamber 1 defined by a cylinder 2 and a piston 3. The cylinder 2 has its lower portion connected through a check valve 4 with a suction pipe 5 and its upper portion formed into such a larger-diameter portion 2*a* as has a larger diameter than the lower portion thereof. Incidentally, the piston 3 is restrained from rising up to the position of the larger-diameter portion 2*a* by the relationship of a pump stroke. The larger-diameter portion 2*a* has its upper end bent to form a bottle mouth 7, which is to be attached to the bottle neck 6*a* of a liquid container 6.

The piston 3 forming the pressurizing chamber 1 is connected to an inner cylindrical member 8 which has a slightly larger diameter and which extends upward to form such a second piston 9 at its upper end as has a larger diameter than that of the piston 3. The second piston 9 thus formed is fitted slidably in a second cylinder 10, while forming an actuating chamber 11, and is disposed at the lower portion of an atomizing head 12.

A valve member 13 is held in the cylindrical member 8 through an annular retaining member 14. The valve member 13 has its tip 13*a* protruding upward from the second piston 9 until it opens and closed the communication hole 15 which is formed in the atomizing head 12. This communication hole 15 has communication through a passage with the nozzle 16 which is disposed at the front portion of the atomizing head 12. The retaining member 14 is formed with a plurality of axial through holes 17, thereby to establishing communication among the actuating chamber 11, the pressurizing chamber 1 and the communication hole 15 by way of the gap between the cylindrical member 8 and the valve member 13 and the axial through holes 17. Between the retaining member 14 and the lower portion of the cylinder 2, on the other hand, there is interposed a spring 18, by which the two pistons 3 and 9 and the cylindrical member 8 are urged upward.

The cylinder 10 forms the actuating chamber 11 and an annular stopper 19 is provided on the lower end portion of the cylinder 10 for regulating the downward movement of the piston 9. The annular stopper 19 has its fixed portion fitted and fixed in a fixing groove 20, which is formed in the atomizing head 12 outside of the cylinder 10. Moreover, the stopper 19 is formed with a depending cylinder 21, which has its lower end portion made slidable in the larger-diameter portion 2*a* of the cylinder 2 so that the atomizing head can be guided to move up and down when it is depressed.

The larger-diameter portion 2*a* of the cylinder 2 has its lower portion formed with a communication port 22, through which a chamber 23 defined by the larger-diameter portion 2*a* of the cylinder 2, by the depending cylinder 21 and by the cylindrical portion 8 is made to have such communication with the inside of the liquid container 6 that the air can flow into and out of the chamber in accordance with the upward and downward movements of the atomizing head 12 and that the pressurized liquid can be returned through the communication port 22 into the liquid chamber 6 even if it leaks to enter the chamber 23 through the gap between the cylinder 10 and the piston 9 defining the actuating chamber 11.

Moreover, the cylinder 2 has its lower inner portion formed with a cut groove 24 and an inward land 25 so that, when the piston 3 approaches its lowermost position, its lower end portion 3 rides the inward land 25 against the urging force of the spring 18 thereby to establish communication of the pressurizing chamber 1 with the atmosphere through the cut groove 24, thus abruptly reducing the pressure in the pressurizing chamber 1 thereby to ensure finish of the atomization. Incidentally, the larger-diameter portion 2*a* of the cylinder 2 has its inner wall formed at its middle level with a cut groove 26, which is operative to prevent the pressure in the liquid container from becoming negative.

The atomizer according to the present invention has the construction thus far described. If the atomizing head is depressed against the urging force of the spring 18, the two pistons 3 and 9 are simultaneously depressed by the abutment engagement between the communication hole 15 leading to the nozzle 16 and the valve member 13 thereby to pressurize the liquid in the pressurizing chamber 1. When the pressures in the pressurizing chamber 1 and in the actuating chamber 11 exceed preset levels, the two pistons 3 and 9 are further depressed against the urging force of the spring 18 by the pressure exerted upon the piston 9 having a larger diameter so that the valve member 13 is moved down in accordance with the depression thereby to open the communication hole 15.

When this communication hole 15 is opened, the pressurized liquid in the pressurizing chamber 1 is atomized out of the nozzle 16 through the communication hole 15. Since, in this case, the downward movement of the piston 9 forming the actuating chamber 11 is restricted by the stopper 19, the piston is prevented from being excessively moved down. As a result, the volumes of the actuating chamber 11 and the pressurizing chamber 1 are prevented from abruptly becoming excessive, thereby preventing the pressure in the pressurizing chamber from being abruptly reduced so that the atomizing condition can always be maintained at a satisfactory state.

After that, if the pressure in the pressurizing chamber 1 is lowered, the two pistons 3 and 9 are raised by the urging force of the spring 18 so that the valve member 13 closes the communication hole 15. If the depression of the atomizing head 12 is then interrupted, the atomizing head 12 is raised together with the two pistons 3 and 9 by the urging force of the spring 18 thereby to evacuate the pressurizing chamber 1 so that the liquid spurts from the liquid container 6 through the check valve 4 into the pressurizing chamber 1, thus making the subsequent atomization possible.

As has been described hereinbefore, according to the present invention, there is provided an atomizer of the type, in which the actuating chamber is so provided as to open and close the communication hole leading to the nozzle in accordance with the pressure in the pressurizing chamber. The volume of the pressurizing chamber is prevented during the atomization from being abruptly increased so that the atomization can be maintained at an excellent state. Moreover, since the cylinder depending from the actuating chamber is constructed to slide in the upper larger-diameter portion of the cylinder forming the pressurizing chamber, its pumping action can be performed stably and smoothly, and the liquid to leak from the actuating chamber, if any, can be prevented from leaking to the outside.

What is claimed is:

1. An atomizer comprising: pressurizing means including a first cylinder and a first piston partly for sucking up a liquid from a liquid container through a check valve into a pressurizing chamber and partly for pressurizing the same; a second piston disposed above and connected to the first-named piston through a cylindrical member, the second-named piston being made to have a larger diameter than that of the first-named piston; a second cylinder receiving the second-named piston in a slidable manner while forming an actuating chamber having communication with said pressurizing chamber; a valve member connected to both the first- and second-named pistons; an atomizing head including a communication hole, which is to be opened and closed by said valve member, and a nozzle, which has communication with said communication hole, for depressing the first- and second-named pistons through their abutment engagements with said valve member; and a spring upwardly urging the first- and second-named piston in a manner to expand said pressurizing chamber, whereby, when the pressure in said pressurizing chamber is boosted by a pumping action, the second-named piston is moved down against the urging force of said spring so that said communication hole is opened thereby to atomize the liquid out of the nozzle, wherein the improvement resides: in that an annular stopper is provided on the lower end portion of the second-named cylinder thereby to make it possible to regulate the stroke, in which the second-named piston is moved in the direction to expand said actuating chamber; in that the first-named cylinder has a larger diameter at its upper portion than at its lower portion; in that said stopper has its lower portion merging into a depending cylinder; and in that said depending cylinder has its lower portion slidable in the larger-diameter portion of the first-named cylinder.

2. An atomizer as set forth in claim 1, wherein the first-named cylinder has its lower portion formed in its inner circumferential wall with a cut groove and an inward land so that said pressurizing chamber can have communication with the atmosphere through said cut groove when the first-named piston is in its lowermost position.

3. An atomizer as set forth in claim 1, wherein said annular stopper and said depending cylinder are made integral, and wherein said stopper is formed with an upper fixed portion, which is to be fitted in a fixing groove formed in the lower portion of said atomizing head thereby to fix said stopper and said depending cylinder.

4. An atomizer as set forth in claim 1, wherein the first-named cylinder is formed above the uppermost position of the first-named piston with a communication port so that the air, which might otherwise be confined in such a chamber as is defined by the larger-diameter portion of the first-named cylinder, by said depending cylinder and by said cylindrical member connecting the first- and second-named pistons may be released through said communication port.

5. An atomizer as set forth in claim 4, wherein the upper larger-diameter portion of the first-named cylinder is formed with a cut groove, through which the inside of said liquid container is made to have communication with the atmosphere when said depending cylinder is moved down.

* * * * *